US006575489B1

(12) United States Patent
White

(10) Patent No.: US 6,575,489 B1
(45) Date of Patent: Jun. 10, 2003

(54) SNOWBOARD ROTATABLE BINDING CONVERSION APPARATUS

(76) Inventor: Rick Albert White, P.O. Box 690, Woodland, WA (US) 98674

( * ) Notice: Subject to any disclaimer, the term of this patent is extended or adjusted under 35 U.S.C. 154(b) by 0 days.

(21) Appl. No.: 10/189,865

(22) Filed: Jul. 5, 2002

(51) Int. Cl.[7] ..... A63C 9/081

(52) U.S. Cl. ..... 280/613; 280/607; 280/629; 280/634; 280/14.24

(58) Field of Search ..... 280/607, 613, 280/617, 618, 619, 620, 623, 626, 629, 633, 634, 14.21, 14.23, 14.24

(56) References Cited

U.S. PATENT DOCUMENTS 4,021,056 A * 5/1977 Oakes ..... 280/613
4,728,116 A * 3/1988 Hill ..... 280/618
4,741,550 A * 5/1988 Dennis ..... 280/618
5,021,017 A * 6/1991 Ott ..... 441/70
5,028,068 A * 7/1991 Donovan ..... 280/618
5,035,443 A * 7/1991 Kincheloe ..... 280/618
5,044,654 A * 9/1991 Meyer ..... 280/613
5,054,807 A * 10/1991 Fauvet ..... 280/607
5,236,216 A * 8/1993 Ratzek ..... 280/607
5,261,689 A * 11/1993 Carpenter et al. ..... 280/618
5,277,635 A * 1/1994 Gillis ..... 441/74
5,354,088 A * 10/1994 Vetter et al. ..... 280/618
D357,296 S * 4/1995 Sims ..... D21/773
5,499,837 A * 3/1996 Hale et al. ..... 280/607
5,505,478 A * 4/1996 Napoliello ..... 280/618
5,553,883 A * 9/1996 Erb ..... 280/607
5,564,719 A * 10/1996 Kisselmann ..... 280/14.23
5,584,492 A * 12/1996 Fardie ..... 280/14.22
5,586,779 A * 12/1996 Dawes et al. ..... 280/14.24
5,667,237 A * 9/1997 Lauer ..... 280/607
5,669,630 A * 9/1997 Perkins et al. ..... 280/613
5,762,357 A * 6/1998 Ratzek et al. ..... 280/607
5,762,358 A * 6/1998 Hale ..... 280/607
5,782,476 A * 7/1998 Fardie ..... 280/14.24
5,820,155 A * 10/1998 Brisco ..... 280/607
5,857,682 A * 1/1999 Hyman ..... 280/14.21
5,868,416 A * 2/1999 Fardie ..... 280/607
5,876,045 A * 3/1999 Acuna, Jr. ..... 280/14.24
5,890,729 A * 4/1999 Bayer et al. ..... 280/618
5,913,530 A * 6/1999 Berger et al. ..... 280/607
5,975,554 A * 11/1999 Linton ..... 280/607
5,984,325 A * 11/1999 Acuna ..... 280/14.24
5,984,346 A * 11/1999 Keller ..... 280/634
6,029,991 A * 2/2000 Frey ..... 280/618
RE36,800 E * 8/2000 Vetter et al. ..... 280/618
6,102,430 A * 8/2000 Reynolds ..... 280/618
6,155,578 A * 12/2000 Patterson ..... 280/14.24
6,155,591 A * 12/2000 Huffman et al. ..... 280/618
6,203,051 B1 * 3/2001 Sabol ..... 280/607
6,206,402 B1 * 3/2001 Tanaka ..... 280/607
6,213,493 B1 * 4/2001 Korman ..... 280/613
6,302,411 B1 * 10/2001 Huffman et al. ..... 280/14.24
6,318,749 B1 * 11/2001 Eglitis et al. ..... 280/607
6,336,650 B1 * 1/2002 Alspaugh ..... 280/613
6,523,851 B1 * 2/2003 Maravetz ..... 280/603

* cited by examiner

*Primary Examiner*—Brian L. Johnson
*Assistant Examiner*—Bridget Avery
(74) *Attorney, Agent, or Firm*—Kurt M. Rylander

(57) ABSTRACT

A snowboard rotatable binding conversion apparatus that is inserted between and attaches to a snowboard and a boot binding to render the boot binding rotatable in relation to the snowboard. The snowboard rotatable binding conversion apparatus includes a base, an engaging plate which sandwiches the base between he engaging plate and a snowboard, a top plate which sandwiches the engaging plate between the top plate and the base, an engaging element which engages an engaging slot in an engaging plate, an engaging bar which movably secures the engaging element to the base, a tension bar that provides tension to the engaging element, a tether attachable to the engaging element, and a plurality of screws and screw-receiving holes to attach the engaging bar to the base, the engaging plate to the snowboard, and the top plate to the base.

13 Claims, 2 Drawing Sheets

SNOWBOARD ROTATABLE BINDING CONVERSION APPARATUS

FIELD OF THE INVENTION

The present invention relates to snowboard bindings, and more particularly to release mechanisms allowing a snowboarder to rotate a snowboard binding without the snowboarder having to release its boot from the binding.

BACKGROUND

Snowboarding is a popular winter sport. Snowboarders board down a snow covered mountain on a snowboard with boots affixed in snowboard bindings.

Two types of bindings are commonly used in snowboarding: the high-back strapped binding and a strapless step-in binding. The high-back strapped binding is characterized by a vertical plastic back piece which is used to apply pressure to the heel-side of the board. This binding has two straps which go over the foot, with one strap holding down the heel and the other holding down the toe. Some high-backs also have a third strap on the vertical back piece called a shin strap which gives additional support and aids in toe side turns. The strapless step-in binding is used with a hard shell boot much like a ski binding except it is non-releasable. With both types of bindings, a typically bottom plate is provided. As shown in FIGS. 1 and 2, bottom plate 62, 66 is provided with screw slots in a standard configuration. Similarly, snowboards typically come provided with four screw-receiving holes matching up to these binding screw slots, as shown in FIG. 1 at 14. The bindings are attached to the snowboard with four screws inserted in these screw slots.

Snowboard boot bindings are normally screwed onto the snowboard in a permanent orientation which is almost perpendicular to the direction of travel of the snowboard. When a snowboarder reaches the bottom of a run, the rear boot is typically released from its binding to allow the snowboarder to propel himself forward across relatively flat snow. Because the front foot in the snowboard binding is at an angle to forward motion, the snowboarder experiences discomfort and tension on his leg, knee, and foot joints. Having the front boot nearly perpendicular to the snowboard with the snowboard and back foot moving straight forward is very uncomfortable and potentially dangerous because a fall in this orientation may injure the ankle or knee joints of the snowboarder. If the snowboarder releases his front boot from the binding, the snowboarder is relegated to walking, carrying his board. Further more it is difficult to mount a chair lift with one foot on the board at an angle to the forward direction of the board, and on a chair lift having the foot nearly perpendicular to the snowboard causes the snowboard to be positioned across the front of the chair which is an awkward orientation for mounting and is disturbing or damaging to anyone seated on an adjacent chair.

The use of rotatable boot binding mechanisms is known in the prior art. More specifically, rotatable boot binding mechanisms heretofore devised and utilized for the purpose of allowing rotation of a boot binding with respect to a snowboard are known to consist basically of familiar, expected and obvious structural configurations, notwithstanding the myriad of designs encompassed by the crowded art which have been developed for the fulfillment of countless objectives and requirements.

A number of devices have provided rotatable snowboard bindings, but lack the improved performance and ease of adjustability of the present invention. Presently known art attempts to address this problem, but has not completely solved the problem. The following represents a list of known related art:

| Reference: | Issued to: | Date of Issue: |
|---|---|---|
| U.S. Pat. No. 6,318,749 | Eglitis et al. | Nov. 20, 2001 |
| U.S. Pat. No. 6,206,402, | Tanaka | Mar. 27, 2001 |
| U.S. Pat. No. 6,203,051 | Sabol | Mar. 20, 2001 |
| U.S. Pat. No. 6,155,578 | Patterson | Dec. 5, 2000 |
| U.S. Pat. No. 6,102,430 | Reynolds | Aug. 15, 2000 |
| U.S. Pat. No. 5,984,325 | Acuna | Nov. 16, 1999 |
| U.S. Pat. No. 5,975,554 | Linton | Nov. 2, 1999 |
| U.S. Pat. No. 5,868,416 | Fardie | Feb. 9, 1999 |
| U.S. Pat. No. 5,782,476 | Fardie | Jul. 21, 1998 |
| U.S. Pat. No. 5,762,358 | Hale et al. | Jun. 9, 1998 |
| U.S. Pat. No. 5,669,630 | Perkins et al. | Sep. 23, 1997 |
| U.S. Pat. No. 5,586,779 | Dawes et al. | Dec. 24, 1996 |
| U.S. Pat. No. 5,584,492 | Fardie | Dec. 17, 1996 |
| U.S. Pat. No. 5,499,837 | Hale et al. | Mar. 19, 1996 |
| U.S. Pat. No. 5,354,088 | Vetter et al. | Oct. 11, 1994 |
| U.S. Pat. No. 5,277,635 | Gillis | Jan. 11, 1994 |
| U.S. Pat. No. 5,236,216 | Ratzek | Aug. 11, 1993 |
| U.S. Pat. No. 5,261,689 | Carpenter et al. | Nov. 16, 1993 |
| U.S. Pat. No. 5,054,807 | Fauvet | Oct. 8, 1991 |
| U.S. Pat. No. 5,044,654 | Meyer | Sep. 3, 1991 |
| U.S. Pat. No. 5,028,068 | Donovan | Jul. 2, 1991 |
| U.S. Pat. No. 5,021,017 | Ott | Jun. 4, 1991 |
| U.S. Pat. No. 4,728,116 | Hill | Mar. 1, 1988 |
| U.S. Pat. No. Re. 36,800 | Vetter et al. | Oct. 11, 1994 |
| U.S. Des. Pat. 357,296 | Sims | Apr. 11, 1995 |

The teachings of each of the above-listed citations (which does not itself incorporate essential material by reference) are herein incorporated by reference. None of the above inventions and patents, taken either singularly or in combination, is seen to describe the instant invention as claimed.

U.S. Pat. No. 5,984,325 to Acuna teaches an adjustable snowboard binding. In the reference the foot remains in the binding, and binding can be locked into a selected angular position using one or more hand manipulated levers. The boot binding itself is the rotation device. Boot must be unstrapped and removed to adjust the position. The boot holding device is built into the disclosed binding-the boot is inserted the binding.

U.S. Pat. No. 6,155,578 to Patterson discloses a snowboard latching mechanism which requires the snowboarder to bend over and with both hands to radially pull outward on handles of boot binding to remove element from notches in binding, and then to rotate the device.

U.S. Pat. No. 6,102,430, to Reynolds discloses a latching mechanism for a snowboard boot binding, wherein the snowboarder bends down and releases a lever which allows the foot in the boot in the binding to be moved angularly in relation to the snowboard.

U.S. Pat. No. 6,206,402, to Tanaka discloses a latching mechanism for a snowboard boot binding in which the boot must be removed, and then the twist locking mechanism manually operated to rotate the binding to desired rotation settings, and then the boot is reinserted.

U.S. Pat. No. 5,586,779, to Dawes et al. teaches a latching mechanism for a snowboard boot binding which includes a screw locking mechanism wherein the screw is screwed into the threaded hole in the binding mount plate, and the mechanism consists of a centrally disposed spring loaded plunger. Dawes claims an adjustable snowboard boot binding apparatus which is rotatably adjustable "on the fly" without removing the boot from the binding and is compatible with existing snowboard boot bindings. A central hub is attached to the board and a top binding mounting plate and bottom circular rotating plate are interconnected and sandwich the hub between them, so that the binding plate and circular plate rotate on a bearing between the binding plate and the central hub. A spring-loaded plunger lock mechanism locks the binding plate to the central hub in a series of holes in the hub. Alternately, gear teeth on the hub may interact with a plunger to lock the device. Several other locking devices are shown.

U.S. Pat. No. 5,028,068, to Donovan describes a quick-action adjustable snowboard boot binding comprising a support plate to which a conventional boot binding is mounted. The support plate is fixedly attached to a circular swivel plate which rotates, via a center bearing, relative to a base plate attached to the board. Donovan discloses a latching mechanism for a snowboard boot binding in which a handle is pivotally mounted on a bracket which is connected to a yoke, which is attached to a flexible cable which, when tightened, prevents the binding from moving. The handle is mounted on a plate below the boot binding. A person must bend down and loosen, and bend down and tighten. A cable encircles a groove in the swivel plate and a handle pivots up to release the cable for adjusting the angle of the swivel plate and pivots down to tighten the swivel plate at a desired angle.

U.S. Pat. No. 6,318,749, issued to Eglitis et al. teaches a latching mechanism for a snowboard boot binding to allow the snowboarder to align his boot with the direction of travel. The snowboarder must bend down and manually grasp a pull ring under the binding and pull outwardly, compressing a spring in the latching mechanism until the locking member disengages from a locking notch.

U.S. Pat. No. 5,975,554 issued to Linton discloses a latching mechanism for a snowboard boot binding to allow a snowboarder to rotate his boot in relation to the snowboard. The disclosed device utilizes a cable around an outer surface of a floating clamp. A specific boot binding must be used. The cable operates through use of a lever. The snowboarder must bend down to flip the lever to engage or disengage.

U.S. Pat. No. 5,669,630, issued to Perkins et al. discloses a latching mechanism for a snowboard boot binding to allow a snowboarder to rotate the boot binding relative to the snowboard. The latching mechanism works through a tie down bolt that must be unscrewed to allow rotation of the boot binding relative to the board. Rotation is done without the foot in the binding.

U.S. Pat. No. Re. 36,800, to Vetter et al. discloses a latching mechanism for releasing a boot binding from a board. The reference discloses bending over and manually lifting up a latch bind held under a spring bias, rotating the foot, and thus disengaging from the board. The reference discloses a quick release for the back foot.

U.S. Pat. No. 5,354,088 to Vetter et al. discloses a coupling for releasably mounting a boot with boot binding to a turntable ring which is adjustably secured to a snowboard. A spring loaded pin with a long cord is the locking mechanism. Vetter does not disclose a secure screw-type up and down locking device, a retrofit capability, a large diameter roller bearing, an elevated lock ring to prevent icing, a central guide post for ease of alignment during assembly, a positive engagement safety device to limit the degree of rotatability during free rotation, a spring rotation control, or an easy grasp elevated T-shaped lock handle for use with gloves or mittens.

U.S. Pat. No. 5,762,358 to Hale et al. discloses a latching mechanism for a snowboard boot binding to allow a snowboarder to rotate his boot while bound to the snowboard, in relation to the snowboard. The reference teaches a base plate, a binding plate, and a hold down disk, wherein the binding plate swivels in relation to the snowboard, the base plate and the hold down disk. A dual lever system is provided on the binding plate, on either side of the boot binding, the rotation of the levers engages and disengages a locking element which engages and disengages the binding plate to effectuate the rotatabilty.

U.S. Pat. No. 5,499,837 to Hale et al. illustrates a swivelable mount for a snowboard having a rotatable binding plate attached to a circular plate which rotates in a circular groove of a base plate secured to the snowboard. A handle with a cam and spring-loaded pin secures the binding plate at a desired angle. Hale does not disclose a secure screw-type up and down locking device, a retrofit capability, a large diameter roller bearing, an elevated lock ring to prevent icing, a central guide post for ease of alignment during assembly, a positive engagement safety device to limit the degree of rotatability during free rotation, a spring rotation control, or an easy grasp elevated T-shaped lock handle for use with gloves or mittens.

U.S. Pat. No. 6,203,051 issued to Sabol discloses a latching mechanism for a snowboard boot binding that allows the snowboarder to rotate the binding in relation to the snowboard. The reference teaches a T-handle screw-type lock which can be secured in the up or down position, an elevated lock ring to prevent icing, and a control guide post for ease of alignment. The snowboarder in operation must bend down and grab the "T" shaped lock handle to change the degree of rotation.

U.S. Pat. Nos. 5,584,492, 5,782,476, and 5,868,416, issued to Fardie disclose a latching mechanism for a snowboard boot binding that allows the snowboarder to rotate the binding in relation to the snowboard. Single or dual levers are actuated to allow rotatability, and to secure the binding from rotation. The levers actuate a band which slides into and out of toothed segments in the binding platform. Fardie provides an adjustable snowboard binding assembly which can be rotatably controlled. The snowboard mounting platforms each have a plurality of inwardly facing radial teeth along the circumference of a centralized circular cutout, the bottom of which rests on four quadrant segments connected to a stainless steel band which moves along a groove in the center of the board activated by a lever. The mounting platform can rotate relative to the four quadrant segments and is locked in place at a desired angle by two spring loaded sliding segments with mating teeth to engage the teeth on the mounting platform to lock it in place at a desired angle.

U.S. Pat. No. 5,236,216 to Ratzek shows a fastening disk that can be clamped upon a binding-support plate that can be turned about a normal axis to the board. Several bolts must be loosened somewhat to allow the rotational position of the binding plate to be changed, then the bolts must be re-tightened.

U.S. Pat. No. 5,261,689 to Carpenter et al. shows a number of bolts through a hold-down plate for a rotatable binding-support plate must be loosened and then re-tightened in order to change the binding orientation.

U.S. Pat. No. 5,044,654 to Meyer shows a system in which a single central bolt must be loosened and re-tightened.

U.S. Pat. No. 5,277,635 to Gillis shows a water skiboard with rotatably adjustable bindings; however, it appears that such mechanism is not adequate for use in the snowboarding environment. It is also noted that the above-mentioned prior devices in their structure and design, do not lend themselves to relatively inexpensive, lightweight, low-profile, bindings mounts that are desirable by those enthusiasts who desire to enhance their snowboarding performance capabilities.

U.S. Pat. No. 5,499,837 to Hale et al. shows an improved snowboard binding support with quick and effective swivelable adjustment capability; however, there remains a need for such a product that has unique structural features that will lend it to easy and efficient fabrication as well as having superior strength, durability, and reliability in the face of the high stresses encountered during normal rigorous use of a snowboard.

Still other features would be desirable in an apparatus for allowing rotation of a snowboard boot binding while the boot is in the binding. For example, to be able to adjust rotation angle of the boot binding with the boot in the binding without the need to bend down, it would be desirable if the snowboarder did not have to bend over, and could merely reach is hand to his knee to grab a tether. In addition, to use the greatest selection of snowboards and boot bindings, it would be desirable to have a rotation apparatus which could easily attach to a large selection of snowboards and to which a large selection of boot bindings could easily be attached. Further, to create ease in angular adjustment of the boot binding in relation to the snowboard, it would be desirable to increase the ease by which the boot could be turned on the rotation apparatus in relation to the snowboard. In addition, to increase stability while riding the snowboard, it would be desirable to have the rotation apparatus attach to the snowboard such that the center of the rotation apparatus is attached, rather than attaching the rotation apparatus around its periphery. Further, to allow the greatest flexibility in choice of snowboards and boot bindings, it would be desirable to have a rotation apparatus which could be attached by the untrained individual using only tools generally available in the home.

Thus, while the foregoing body of art indicates it to be well known to have a boot binding that is rotatable in relation to a snowboard, and which may be angularly adjusted while the boot is in the boot binding, the art described above does not teach or suggest a snowboard binding plate rotation apparatus which has the following combination of desirable features: (1) allows the snowboarder to rotate the snowboard boot binding in relation to the snowboard without removing his boot from the boot binding; (2) allows the snowboarder to rotate the snowboard boot binding by simply pulling upon a tether attached to his or her leg and turning his or her boot; (3) can be attached to a great variety of boot bindings in the commercial market place, allowing the user a great selection of different boot bindings, such as strapped boot bindings and step-in boot bindings; (4) can easily be attached to snowboards, allowing the snowboarder to choose among commercially available snowboards; (5) can easily attach to boot bindings, allowing the snowboarder to choose among commercially available boot bindings; (6) is easy to manufacture with a relatively limited number of parts; (7) has a base that rotates in relation to the snowboard with the boot binding attached to the base, as opposed to existing techniques wherein the base remains fixed, and the boot binding rotates in relation to the base; and (8) can be attached to a snowboard and a boot binding with tools easily available in the home, and without the need of a trained alpine technician.

SUMMARY AND ADVANTAGES

The snowboard rotatable binding conversion apparatus of the present invention is inserted between a snowboard and a boot binding to render the boot binding rotatable in relation to the snowboard. The snowboard rotatable binding conversion apparatus includes a base, an engaging plate attachable to a snowboard, which sits upon and within the base and has engaging slots around the perimeter of the engaging plate, a top plate attachable to a boot binding, which sits upon and within the base and over the engaging plate sandwiching the engaging plate between the top plate and the base, an engaging element within a slot in the base which engages an engaging slot in an engaging plate, an engaging bar which sits within an engaging bar slot in the base and movably secures the engaging element to the base, a tension bar that sits within a tension bar slot in the base and inserts through and provides tension to the engaging element, a tether attachable to the engaging element, and a plurality of screws and screw-receiving holes to attach the engaging bar to the base, the engaging plate to the snowboard, and the top plate to the base.

The snowboard rotatable binding conversion apparatus attaches to a snowboard and to a boot binding. The snowboarder can choose from a number of commercially available boot bindings and snow boards to be connected to the present invention. This allows the snowboarder to have great flexibility and choice in selecting both his board, as well as his particular boot binding.

The snowboard rotatable binding conversion apparatus of the present invention presents numerous advantages, including: (1) snowboarder may rotate the snowboard boot binding in relation to the snowboard without removing his boot from the boot binding; (2) the rotation can be accomplished without bending down to the ground to operate any levers—the snowboarder can simply pull up on a tether attached to his leg; (3) useable with a number of boot bindings, boot bindings can be attached to the present invention, allowing the snowboarder to choose among the great variety of boot bindings present in the commercial market place; (4) easy to attach to boot bindings, allowing the snowboarder to choose among commercially available boot bindings; (5) easy to attach to a snowboard, allowing the snowboarder to have a great selection of snowboards and boot bindings, as mentioned above, from which to select; (6) easy to manufacture with a relatively limited number of parts; (7) advantageous aspect of having a base that the base rotates in relation to the snowboard and the boot binding attaches to the base, as opposed to other art wherein the base remains fixed, and the boot binding rotates in relation to the base; (8) the apparatus can be attached to a snowboard and a boot binding with tools easily available in the home, and without the need of a trained alpine technician.

Additional advantages of the invention will be set forth in part in the description which follows, and in part will be obvious from the description, or may be learned by practice of the invention. The advantages of the invention may be realized and attained by means of the instrumentalities and combinations particularly pointed out in the appended claims. Further benefits and advantages of the embodiments of the invention will become apparent from consideration of the following detailed description given with reference to the accompanying drawings, which specify and show preferred embodiments of the present invention.

DETAILED DESCRIPTION

Before beginning a detailed description of the subject invention, mention of the following is in order. When appropriate, like reference materials and characters are used to designate identical, corresponding, or similar components in differing figure drawings. The figure drawings associated with this disclosure typically are not drawn with dimensional accuracy to scale, i.e., such drawings have been drafted with a focus on clarity of viewing and understanding rather than dimensional accuracy.

Figure 2:
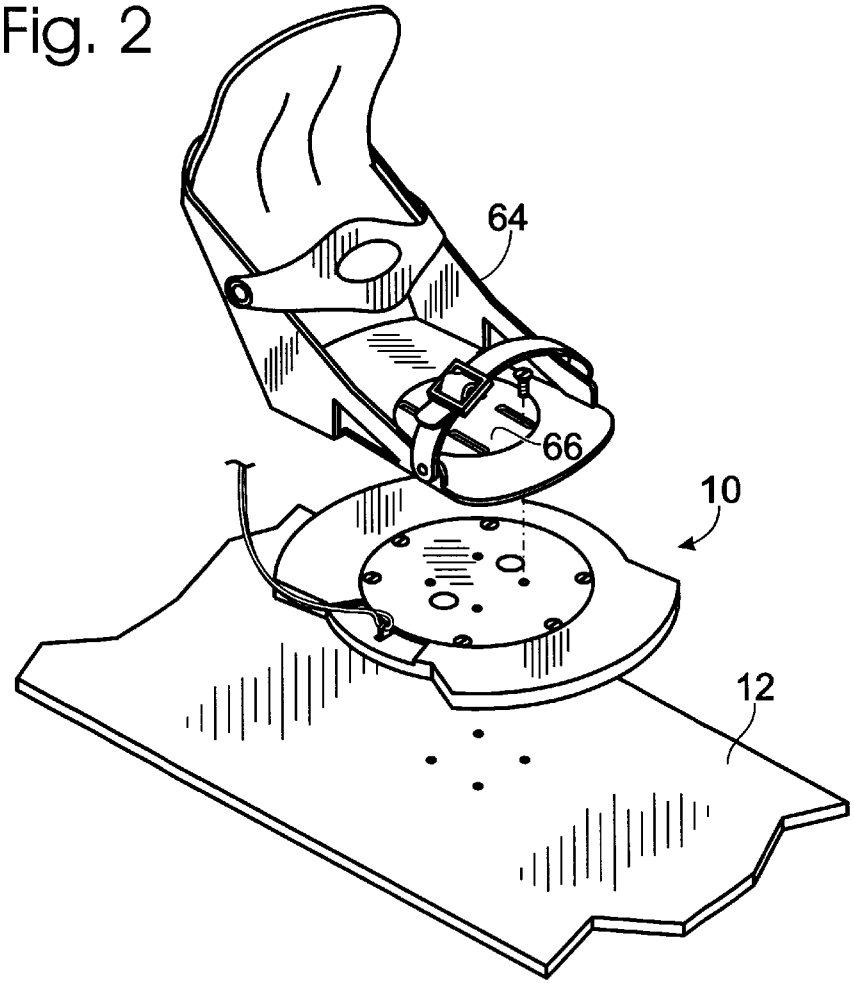
FIG. 2 shows and embodiment of the present invention being attached to a snowboard and a high back, strapped boot binding.
Figure 1:
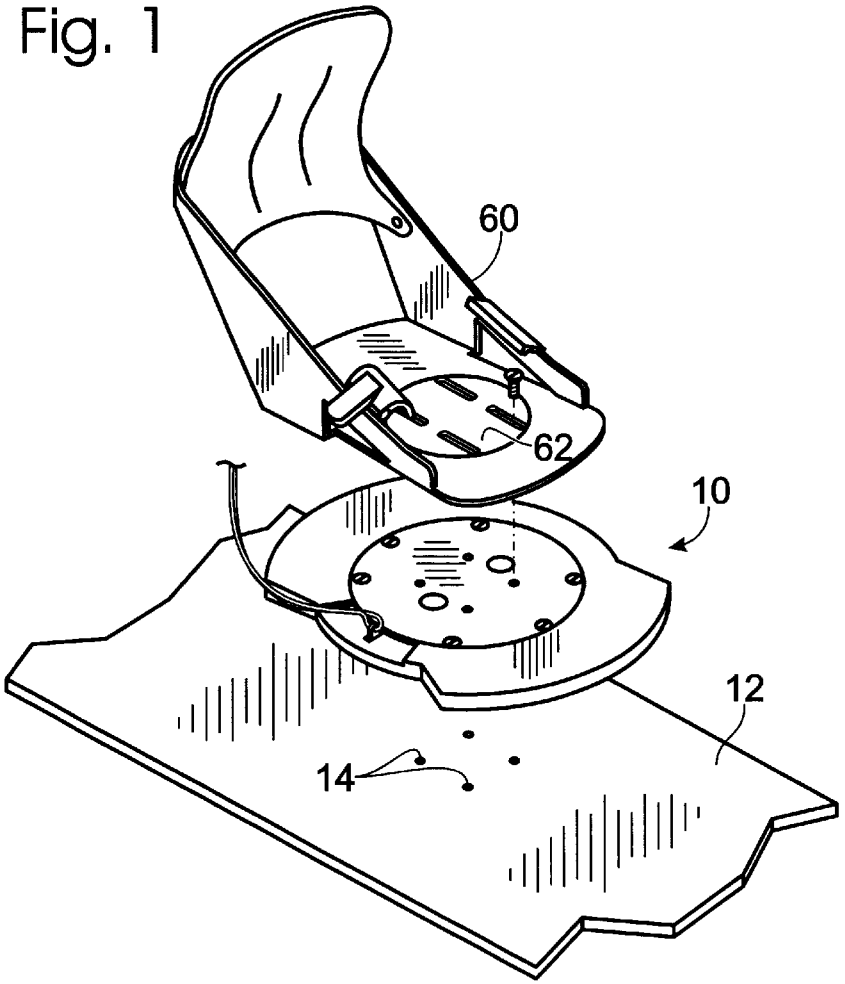
FIG. 1 shows an embodiment of the present invention being attached to a snowboard and a step-in style boot binding.
Figure 3:
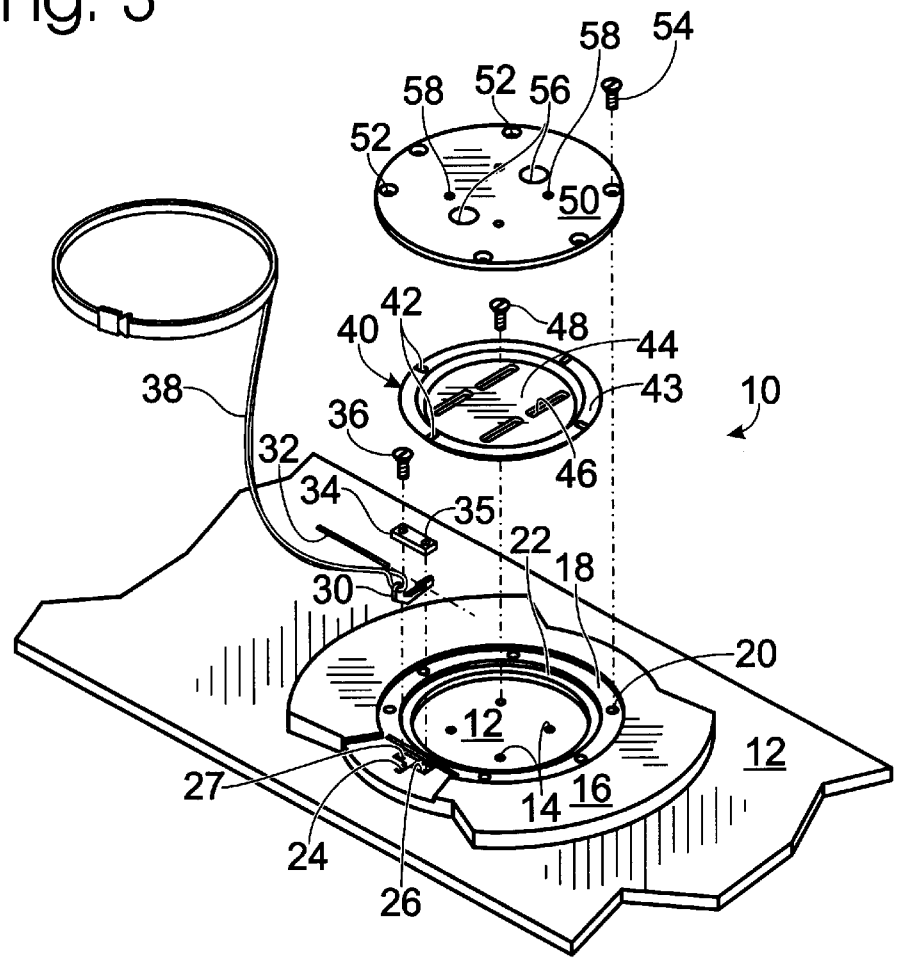
FIG. 3 shows an exploded view of an embodiment of the present invention.
Figure 4:
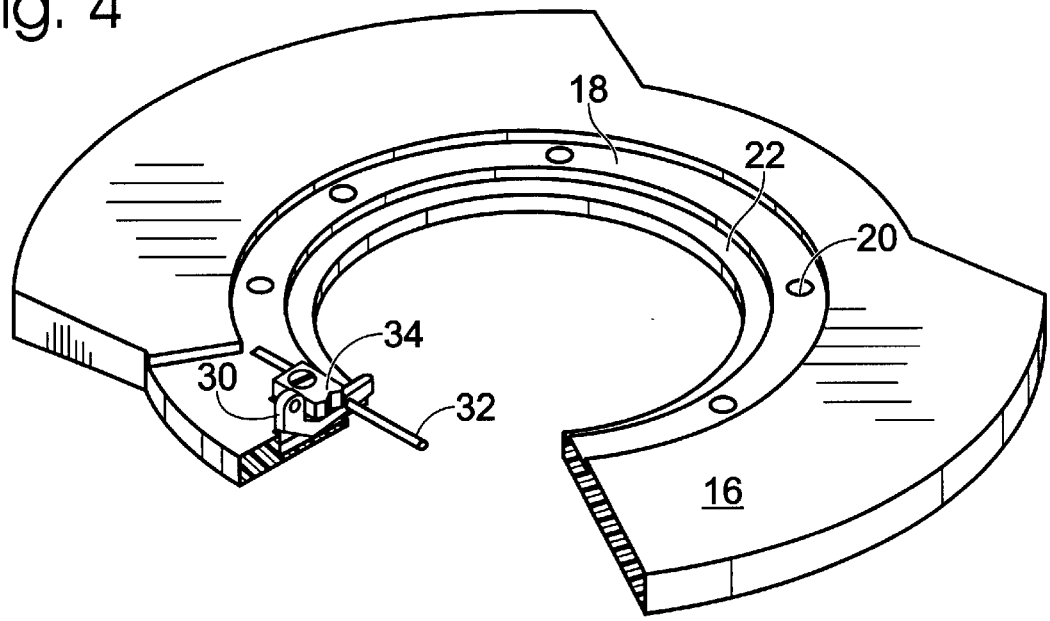
FIG. 4 shows a cut away view of an embodiment of the present invention.

As shown in FIGS. 1, 2, and 3, a snowboard rotatable binding conversion apparatus 10 is provided and is attachable to a snowboard 12 and to a boot binding 60, 64 through the boot binding plate 62, 66. As shown in FIGS. 3 and 4, snowboard rotatable binding conversion apparatus 10 comprises a base 16, an engaging plate 40 attachable to a snowboard 12 and sitting upon and within the base, a top plate 50 attachable to a boot binding 60, 64 and connected to and sitting upon and within the base and over the engaging plate movably sandwiching the engaging plate between the base and the top plate, an engaging element 30 that fits within an engaging element slot 24 in the base and engages with engaging slots 42 in the engaging plate 40, an engaging element bar 34 that fits within a bar slot 26 in the base and movably secures the engaging element within the base, a tension rod 32 that inserts through the engaging element 30 and fits within a tension rod slot 28 in the base and provides upward tension to the engaging element, a tether 38 attachable to the engaging element that is pulled to release engaging element from engaging slot in engaging plate to allow base and top plate to rotate relative to engaging plate and snowboard, and a plurality of screws, including base-top plate screws 54, which secure top plate to base through screw-receiving holes 52 and 20, respectively, engaging element-snowboard screws 48, which secure engaging plate to snowboard through screw slots 46 in engaging plate, engaging bar-base screws 36 which secure engaging bar to base through engaging bar screw-receiving holes 35 and base screw-receiving holes 27, and binding attachment screw-receiving holes 58 which receiving screws attaching boot binding to top plate.

In preferred embodiment, base 16, engaging plate 40, and top plate 50 are made of cast aluminum. Numerous methods are known to those skilled in the art for casting aluminum. Alternatively, the elements can be cut from aluminum. Similarly, the elements can be made from other materials, such as stainless or plated steel, other equally suitable material well known to those skilled in the art. In the preferred embodiment, the engaging element, engaging bar, and tension rod are made of stainless steel. Alternatively, these elements can be made from any number of other materials providing strength, durability, and the ability to function in a cold environment, well known to those skilled in the art. These elements can be shaped through numerous methods, such as casting. Alternatively, the elements can be cut. The screws are standard screws purchasable in any hardware store. In the preferred embodiment, alien head counter sunk screws are used. In the preferred embodiment, the tether attaches to the engaging element with a key ring loop, and the tether is made of a fabric strap. Tether can be made of any number of materials, including rope, leather, reinforced fabric, and other equally suitable material well known to those skilled in the art.

As show in FIG. 3, base 16 in preferred embodiment is roughly disc shaped ring with an interior perimeter stepped in two ledges. Base sits upon and is rotatable in relation to the snowboard top. Base is provided with first and second ringed ledges 18, 22 defining the interior perimeter. Ringed ledges 18, 22 are at different levels within the base, and have different diameters. The first ringed ledge 22 upon which the edge of the engaging plate 40 fits, and the second ringed ledge cutout 18 upon which the edge of the top plate 50 fits.

Base can be provided with a plastic cushion (not shown) on the bottom of the base, to cushion the rotation of the base on the snowboard. The plastic cushion is molded and bonded to the base in a well known manner. Thus, the cushion is essentially simultaneously molded and bonded to the base which has been prepared in a suitable manner prior to molding. While any suitable plastic material having a low coefficient of friction, a high compressive strength and a high resistance to wear may be used, it will be appreciated that the plastic material preferably be a linear high-density polyethylene which is usually referred to as an ultra-high molecular weight polyethylene ("UHMW plastic"). One such acceptable polymer material is defined as "1900 UMHW polymer" and available from Himont U.S.A., while another acceptable UHMW plastic marketed under the registered trademark HOSTALEN GUR412 LS and GUR422 is available from American Hoechst Corporation.

Base 16 is provided with an engaging element slot 24 on the side of, normal to, and through the ringed ledges 18, 22 of the base. Engaging element fits within the slot 24 to bisect a portion of the ringed ledges. Engaging element 30 is roughly "J" shaped, with a pointed, or rounded, lateral length. An engaging bar cutout 26 is provided within the base and is perpendicular to, over, and across the engaging element slot. Engaging bar 34 fits within the engaging bar cutout and over the engaging element to prevent the engaging element from being removed from the base. Engaging element pivots beneath the engaging bar. A tension rod slot 28 is provided within the base along a portion of the second ringed ledge cutout 18, and perpendicular to the engaging element slot 24. Tension rod 32 fits within tension rod slot 28 and underneath the top plate. As shown in FIGS. 3 and 4, tension rod fits through engaging element. Tension rod when inserted through engaging element and placed in base provides upward tension on the engaging element.

Engaging plate 40 is provided with a raised perimeter ring 43 and a sunken circular expanse 44. As shown in FIG. 3, the sunken expanse 44 of the engaging plate 40 fits within center of base and upon the first ringed ledge. This allows the engaging plate to contact with and be attached to the top of a snowboard 12. The base is movably sandwiched between the snowboard and the engaging plate. Sunken expanse is provided with a plurality of screw slots 46, preferably four. Screws 48 insert through screw slots to attach the sunken expanse of engaging plate to snowboard. As shown in FIGS. 1, 2, and 3, commercially available snowboards typically come provided with a standard configuration of screw-receiving holes 14. Those skilled in the art will know that screw-receiving holes can easily be provided in a snowboard. Raised perimeter ring 43 of engaging plate is provided with a plurality of engaging slots 42 along the outside perimeter of the ring. While only four engaging slots are shown, it is recognized that the engaging plate can be provided with more or fewer engaging slots, and the invention is not limited by the number of engaging slots shown. Engaging element fits within engaging slot to prevent rotation of the base and top plate in relation to the engaging plate and snowboard.

Top plate 50 sits within based upon a second ringed ledge 18 of the base, above the engaging plate, and attaches to the base, movably sandwiching the engaging plate between the base and the top plate. When a snowboard boot binding is attached to the top plate, and the engaging element is release from the engaging plate, the boot turns the top plate and the base in relation to the snowboard and the engaging plate. Top plate 50 is provided with a plurality of screw-receiving holes 52 around its perimeter. Base-top plate screws 54 insert through screw-receiving holes 52 in top plate and mate with screw-receiving holes 20 in second ringed ledge 18 of base to secure the top plate to the base. When top plate is secured to base, top plate covers tension bar in tension bar slot. Base-top plate screws 54 are preferably counter-sunk allen head screws. Top plate is further provided with binding attachment screw-receiving holes 58 matching to standard configuration of screw-receiving holes found in boot bindings, see FIGS. 1 and 2. Top plate is further provided with top plate access holes 56, located as shown in FIGS. 1, 2 and 3, which are holes larger than screw receiving holes, and through which an operator can access the engaging plate screw slots from the top side of the top plate.

As shown in FIGS. 1, 2 and 3, boot bindings attach to top plate through binding attachment screw-receiving holes 58 in top plate which match to standard screw slot configuration provided in boot plates 62, 66 that come with commercially available boot bindings. User inserts screws through boot plate screw slots and screws into binding attachment screw-receiving holes 58 in top plate in same fashion that user would screw boot bindings to snowboard.

Apparatus is assembled by taking the base 16, fitting the tension rod 32 through the engaging element 30, inserting the engaging element into the engaging element slot 24 while simultaneously inserting the tension rod into the tension rod slot 28, inserting the engaging element bar 34 into the engaging bar cutout 26, over the engaging element and tension rod, and screwing the bar into place, then inserting the engaging plate 40 into the base and upon the first ringed ledge 22 of the base, placing the base on top of the snowboard and over the screw-receiving holes 14 provided in the snowboard, and screwing the engaging plate to the snowboard with screws 48 inserted through the engaging screw slots 46 in the sunken expanse 44 of the engaging plate. The snowboarder then inserts the top plate 50 into the base and upon the second ringed ledge 18, over the engaging plate, and screws the top plate to the base through the screw-receiving holes 52 provided around the perimeter of the top plate and the screw-receiving holes 20 upon the and around the second ringed ledge of the base. Snowboarder will typically use a standard screw driver, either Phillips or flat head, or an Allen wrench, to perform these operations.

A snowboarder can select a snowboard form among numerous commercially available snowboards. As shown in FIGS. 1, 2 and 3, snowboards typically come provided with screw-receiving holes in the top of the snowboard in a standard configuration in the place where the boot binding is to be attached. The snowboarder attaches the snowboard rotatable binding conversion apparatus to the snowboard and boot binding by first attaching the snowboard rotatable binding conversion apparatus to the snowboard or, if the snowboard is already provided with a boot binding, by unscrewing the boot binding attachment screws and detaching the boot binding, and then screwing to the snowboard to attach the snowboard rotatable binding conversion apparatus. Snowboard rotatable binding conversion apparatus is attached to snowboard by placing the apparatus over the screw-receiving holes 14 in the snowboard, and aligning, by looking through the access holes 52 in the top plate, the engaging plate screw slots 46 to the screw-receiving holes 14 in the snowboard. This allows alignment of two engaging plate screw slots and two screw-receiving holes at a time. The snowboarder then pulls up on the tether 38, or on the engaging element 30, to disengage the engaging element from an engaging slot 42 in the engaging plate, and turns the top plate and base in relation to the engaging plate, to bring the access holes 56 in alignment over the remaining engaging plate screw slots, to allow alignment with the snowboard screw-receiving holes 14 so that the remaining two screws can be screwed in. This may be repeated two or three times to tighten all the screws down. The apparatus is now attached to the snowboard. The snowboarder then attaches the boot binding to the top plate by aligning the screw slots provided in the boot binding to the binding attachment screw-receiving holes 58 in the top plate an screwing the boot binding to the top plate. The boot binding is now attached to the top plate.

In operation in one embodiment, on the ski slopes to rotate the boot binding, the snowboarder pulls on tether 38 and turns his or her foot. Tether pivots engaging element, releasing engaging element 30 from engaging slot 42 in engaging plate 40. While tether is pulled, snowboarder rotates foot to the desired angle on the snowboard, rotating the base and the top plate in relation to the snowboard and the engaging plate. Snowboarder releases tension on tether. Tension applied by tension rod 32 to the engaging element provides upward tension on the engaging portion of the engaging element, forcing engaging element into engaging slot of engaging plate. Snowboarder may be required to make short turning motions, clockwise and counterclockwise, to align a slot on the engaging plate to the engaging element to allow engagement.

Those skilled in the art will recognize that numerous modifications and changes may be made to the preferred embodiment without departing from the scope of the claimed invention. It will, of course, be understood that modifications of the invention, in its various aspects, will be apparent to those skilled in the art, some being apparent only after study, others being matters of routine mechanical, chemical and electronic design. No single feature, function or property of the preferred embodiment is essential. Other embodiments are possible, their specific designs depending upon the particular application. As such, the scope of the invention should not be limited by the particular embodiments herein described but should be defined only by the appended claims and equivalents thereof.

I claim:

1. A snowboard binding rotation conversion apparatus, comprising:

a. a base;

b. an engaging plate movably connected to said base and attachable to a snowboard, wherein the engaging plate is provided with a plurality of engaging slots around the perimeter of said engaging plate, wherein said engaging plate is provided with a circular sunken expanse that fits through an interior removed circle of said base, allowing said sunken expanse to directly contact the top of a snowboard, and wherein said engaging plate is further provided with a raised ring perimeter that fits within the base and rests upon a concentric ring cutout from said base;

c. a top plate connected to said base and attachable to a boot binding, wherein the top plate is provided with access holes which allow access to the engaging plate, and wherein the top plate is provided with boot binding screw-receiving holes with which the top plate can be attached to a boot binding;

d. an engaging element movably connected to said base and engageable with said engaging slots in said engaging plate, wherein said engaging element fits within an engaging element slot in said base;

e. a tether connected to said engaging element;

f. an engaging bar inserted within a cut out in said base, wherein the engaging bar fits across and over said engaging element;

g. a tension bar inserted through the engaging element and into a slot in said base; and h. a plurality of screws insertable within said base, said engaging plate, said top plate, and said engaging bar.

2. The snowboard binding rotation conversion apparatus of claim 1, further comprising screws for attaching a boot binding to the top plate.

3. The snowboard binding rotation conversion apparatus of claims 1 or 2, wherein the top plate, engaging plate, base, engaging element, and engaging bar are made of aluminum and wherein the tension bar and screws are made of stainless steel.

4. The snowboard binding rotation conversion apparatus of claims 1 or 2, wherein the base is provided with a cushion on the bottom to decrease friction in the rotation of the base upon the top of a snowboard.

5. The snowboard binding rotation conversion apparatus of claims 3, wherein the tether is attached to the engaging element by a key ring.

6. The snowboard binding rotation conversion apparatus of claim 4, wherein the apparatus is provided on a snowboard.

7. A process of taking a snowboard and a boot binding and making a snowboard with a boot binding which can be angularly adjusted while the boot is in the binding, comprising steps of:

a. attaching to a snowboard, a snowboard binding rotation conversion apparatus comprising:

ii. a base;

iii. an engaging plate movably connected to said base and attachable to a snowboard, wherein the engaging plate is provided with a plurality of engaging slots around the perimeter of said engaging plate, wherein said engaging plate is provided with a circular sunken expanse that fits through an interior removed circle of said base, allowing said sunken expanse to directly contact the top of a snowboard, and wherein said engaging plate is further provided with a raised ring perimeter that fits within the base and rests upon a concentric ring cutout from said base;

iv. a top plate connected to said base and attachable to a boot binding, wherein the top plate is provided with access holes which allow access to the engaging plate, and wherein the top plate is provided with boot binding screw-receiving holes with which the top plate can be attached to a boot binding;

v. an engaging element movably connected to said base and engageable with said engaging slots in said engaging plate, wherein said engaging element fits within an engaging element slot in said base;

vi. a tether connected to said engaging element;

vii. an engaging bar inserted within a cut out in said base, wherein the engaging bar fits across and over said engaging element;

viii. a tension rod inserted through the engaging element and into a slot in said base; and ix. a plurality of screws insertable within said base, said engaging plate, said top plate, and said engaging bar; and b. attaching the boot binding, by screwing the boot binding to said top plate.

8. The process of claim 7, wherein the snowboard comes provided with a boot binding attached, further comprising the step of, prior to the step of attaching to a snowboard, a snowboard binding rotation conversion apparatus comprising, removing the boot binding attached to a snowboard by unscrewing the boot binding from the snowboard.

9. The process of claim 8, further including the steps of attaching the snowboard binding rotation conversion apparatus to the snowboard, through the same boot binding screw-receiving holes in the snowboard that the boot binding used, by screwing the engaging plate sunken expanse to the snowboard, wherein accessing the screw slots in the engaging plate to align the engaging plate screw slots to the screw-receiving holes in the snowboard is done by pulling upon the tether, or alternatively the engaging element, which allows the top plate and base to be rotated in relation to the snowboard and engaging plate, aligning the engaging plate screw slots to the snowboard screw-receiving holes through the access holes in the top plate and then screwing the engaging plate to the snowboard, and then placing the boot binding, or alternatively, different boot binding if a new boot binding is desired, on the top plate and screwing the boot binding into the boot binding screw-receiving holes.

10. The snowboard binding rotation conversion apparatus of claims 7, 8 or 9, further comprising screws for attaching a boot binding to the top plate.

11. The snowboard binding rotation conversion apparatus of claims 7, 8 or 9, wherein the tether is attached to the engaging element by a key ring.

12. The snowboard binding rotation conversion apparatus of claims 10, wherein the top plate, engaging plate, base, engaging element, and engaging bar are made of aluminum and wherein the tension bar and screws are made of stainless steel.

13. The snowboard binding rotation conversion apparatus of claims 11, wherein the base is provided with a cushion on the bottom to decrease friction in the rotation of the base upon the top of a snowboard.

* * * * *